US010986923B2

(12) United States Patent
Kachirski

(10) Patent No.: US 10,986,923 B2
(45) Date of Patent: Apr. 27, 2021

(54) MOTORIZED ZERO GRAVITY CHAIR

(71) Applicant: Bill Kachirski, Adelaide (AU)

(72) Inventor: Bill Kachirski, Adelaide (AU)

( * ) Notice: Subject to any disclaimer, the term of this patent is extended or adjusted under 35 U.S.C. 154(b) by 0 days.

(21) Appl. No.: 16/623,565

(22) PCT Filed: Jun. 21, 2018

(86) PCT No.: PCT/AU2018/050613

§ 371 (c)(1),
(2) Date: Dec. 17, 2019

(87) PCT Pub. No.: WO2018/232456

PCT Pub. Date: Dec. 27, 2018

(65) Prior Publication Data

US 2020/0383477 A1 Dec. 10, 2020

(30) Foreign Application Priority Data

Jun. 22, 2017 (AU) ..... 2017902411

(51) Int. Cl.

| | |
|---|---|
| ***A61G 5/14*** | (2006.01) |
| ***A47C 1/0355*** | (2013.01) |
| ***A47C 1/035*** | (2006.01) |
| *A47C 1/032* | (2006.01) |
| *A47C 1/034* | (2006.01) |
| *A47C 7/00* | (2006.01) |
| *A61G 5/08* | (2006.01) |
| *A47C 3/24* | (2006.01) |

(52) U.S. Cl.

CPC ..... *A47C 1/0355* (2013.01); *A47C 1/0352* (2013.01); *A47C 1/0345* (2013.01); *A47C 1/03211* (2013.01); *A47C 3/24* (2013.01); *A47C 7/006* (2013.01); *A61G 5/0825* (2016.11); *A61G 5/0841* (2016.11); *A61G 5/0858* (2016.11); *A61G 5/14* (2013.01)

(58) Field of Classification Search

CPC ..... A47C 1/0355; A47C 1/0352; A47C 3/24; A47C 1/03211; A47C 1/0345; A61G 5/14; A61G 5/0825; A61G 5/0841; A61G 5/0858; B60N 2/162; B60N 2/1817; B60N 2/508

See application file for complete search history.

(56) References Cited

U.S. PATENT DOCUMENTS

| | | | | |
|---|---|---|---|---|
| 3,127,188 | A | 3/1964 | Greub | |
| 4,432,425 | A | 2/1984 | Nitzberg | |
| 7,055,840 | B1 * | 6/2006 | Kelso | A61G 5/10 280/250.1 |
| 2004/0000773 | A1 * | 1/2004 | Li | A61G 5/0841 280/642 |
| 2005/0046129 | A1 * | 3/2005 | Antonishak | A61G 5/1059 280/47.4 |

* cited by examiner

*Primary Examiner* — Syed A Islam
(74) *Attorney, Agent, or Firm* — Sand, Sebolt & Wernow Co., LPA

(57) ABSTRACT

A motorized tilting mechanism for a reclining chair allows the chair be placed in a zero gravity position. A base frame comprising 2 sub-frames pivot in relation to each other to provide simple tilting mechanism.

5 Claims, 4 Drawing Sheets

MOTORIZED ZERO GRAVITY CHAIR

FIELD OF THE INVENTION

The present invention relates to motorized reclining chairs, in particular to chairs that can be placed in a zero gravity position.

BACKGROUND TO THE INVENTION

Motorized reclining chairs are well known with tens of thousands of chairs being produced monthly. Typically a chair will have two drive mechanisms, the first to recline the back of the chair and the second to extend the footrest. These mechanisms may also interact with the seat bottom to provide a small variation in tilt. Such motorized chairs have found wide acceptance in homes around the world and are particularly favoured by the aged or infirm, particularly people with medical conditions. Similar chairs with further drive mechanisms to independently tilt the back with respect to the base are also popular for bariatric use.

Zero gravity chairs which are movable to a heart-rest, or Trendelenburg, position in which the legs are raised to be level with or above the heart are used widely in clinical and even home situations to alleviate blood pooling in the legs and improve or increase blood/fluid circulation. Typically the home versions of such chairs are manually operated, with motorized operation restricted to large, expensive and bulky clinical chairs.

It would be desirable to combine the zero gravity feature in to home based motorized reclining chairs to benefit a large number of aged, infirm or obese people. Known examples of such chairs typically tilt the chair from a separate base frame and as such are unnecessarily complex and hence expensive and inaccessible to the masses.

The object of this invention is to provide a motorized reclining chair with a simple tilt function to alleviate the above problem, or at least provide the public with a useful alternative.

SUMMARY OF THE INVENTION

In a first aspect the invention provides a tilting mechanism for a chair, comprising a first sub-frame in contact with the ground and connected to the back, seat and footrest of the chair, and a second sub-frame in contact with the ground and pivotally connected to the first sub-frame, wherein pivotal rotation of the first and second sub-frames with respect to each other effects a tilting of the back, seat and footrest of the chair.

Preferably the first sub-frame and second sub-frame are in contact with the ground via wheels.

In preference the first and second sub-frames are pivotally rotated with respect to each other by an electric motor driving a linear actuator connected between the first and second sub-frames, and tilting of the back, seat and footrest of the chair puts the chair in a zero gravity position.

The chair may be a geriatric chair or a bariatric chair.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DRAWING COMPONENTS

The drawings include the following integers

Figure 1A:
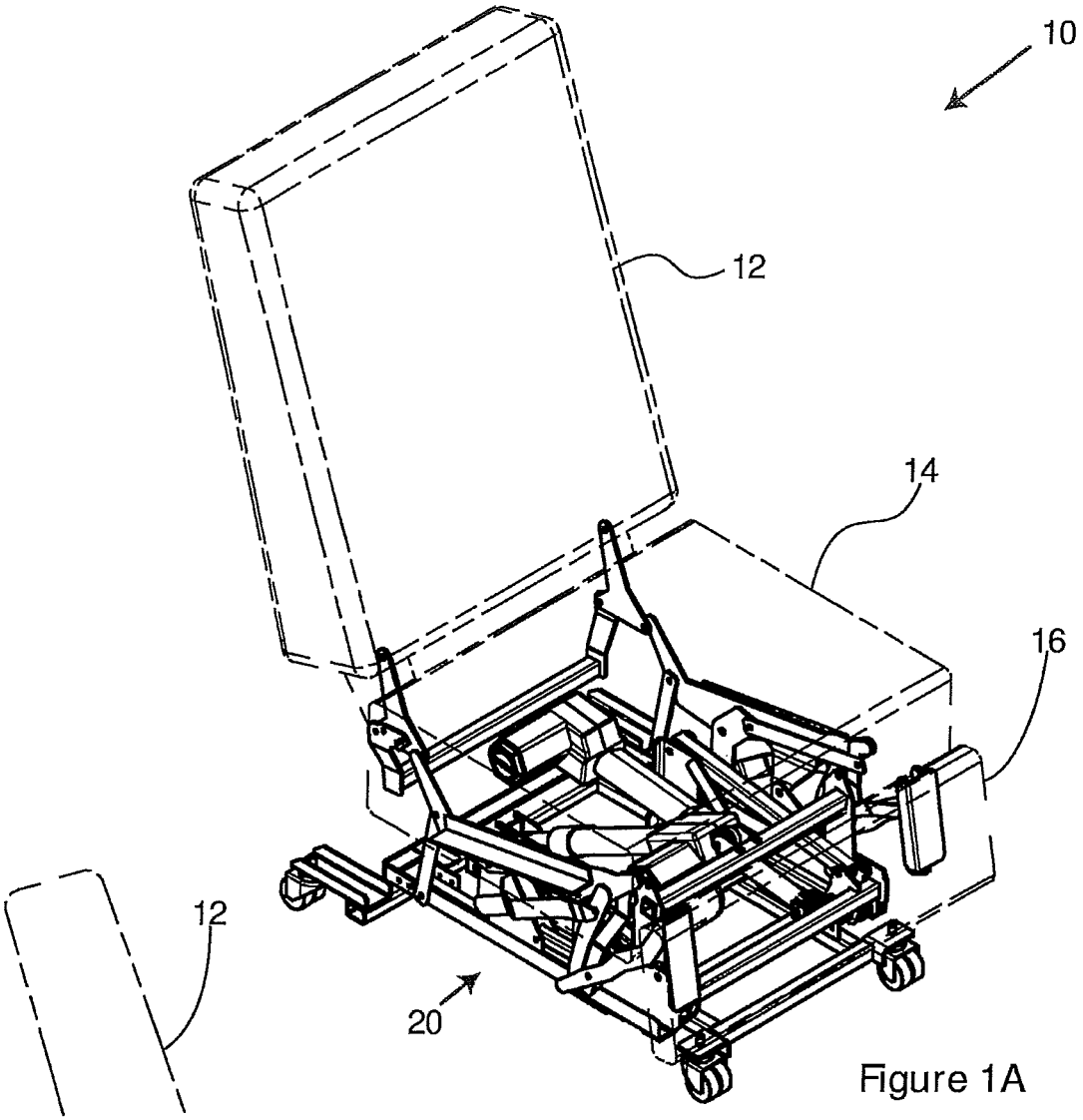
FIGS. 1A and 1B show perspective and side views of a reclining chair incorporating the invention in a neutral position.

10. reclining chair
12 back
14 seat
16 footrest
20 base frame
30 rear sub-frame
32 rear wheels
40 front sub-frame
42 front wheels
50 drive mechanism
52 motor
54 linear actuator

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

The present invention provides a simple motorized tilting mechanism for a reclining chair allowing it to be placed in a zero gravity position. Unlike known mechanisms which pivot the bulk of the chair from a base frame, the invention provides a base frame comprising 2 sub-frames which pivot in relation to each other thus providing a simple tilting mechanism for typical geriatric and bariatric chairs.

Figure 1B:
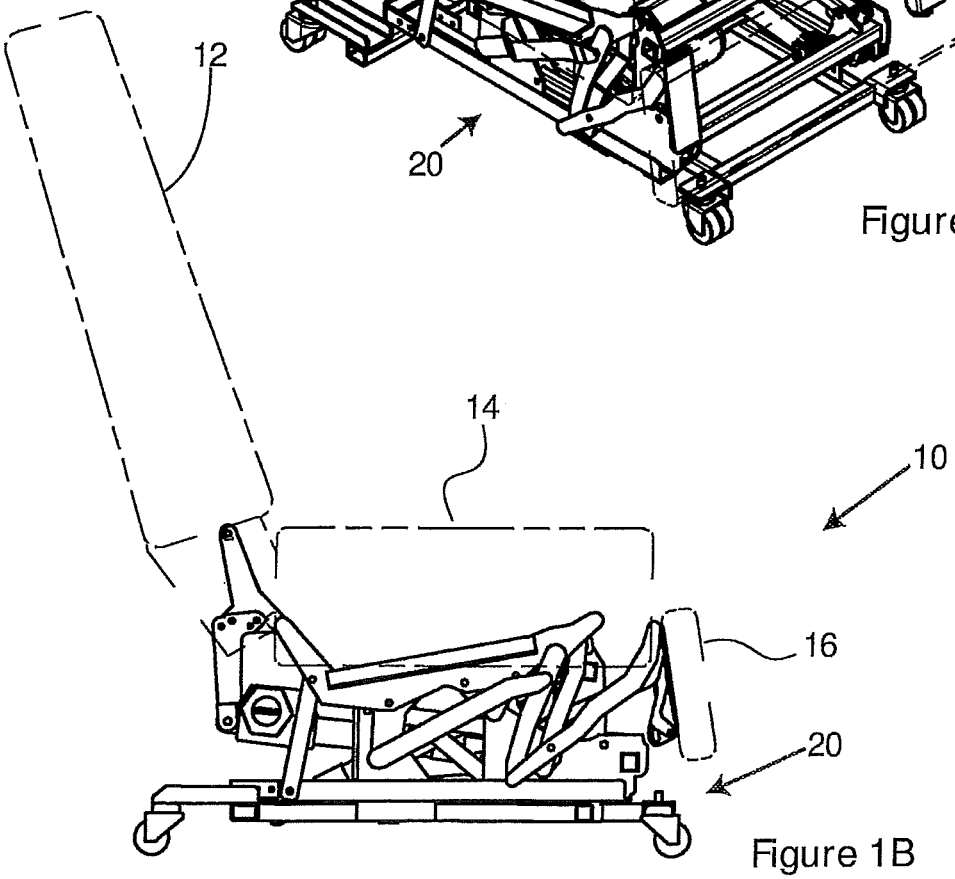
Figure 2A:
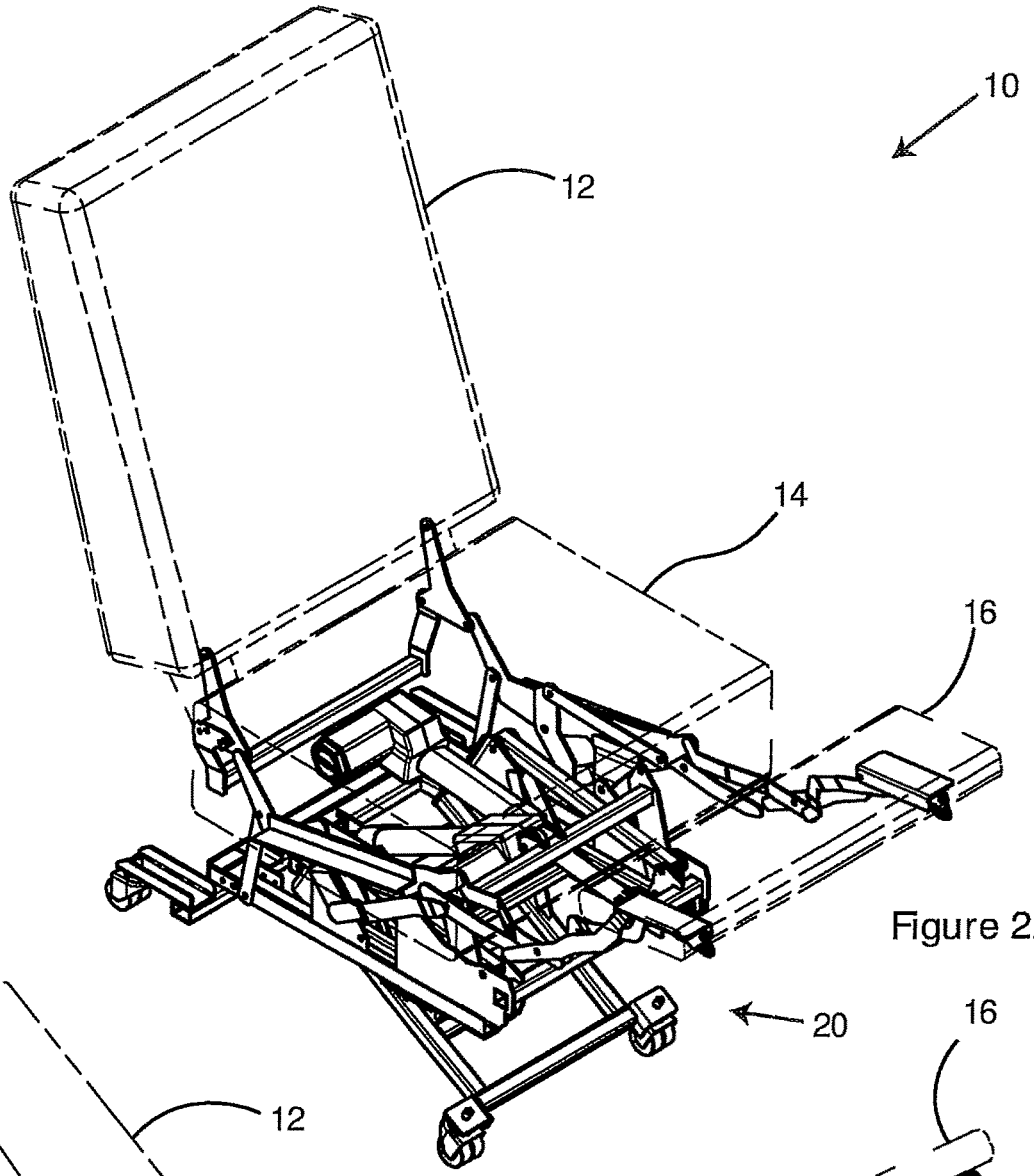
FIGS. 2A and 2B show perspective and side views of a reclining chair incorporating the invention in a tilted position.
Figure 2B:
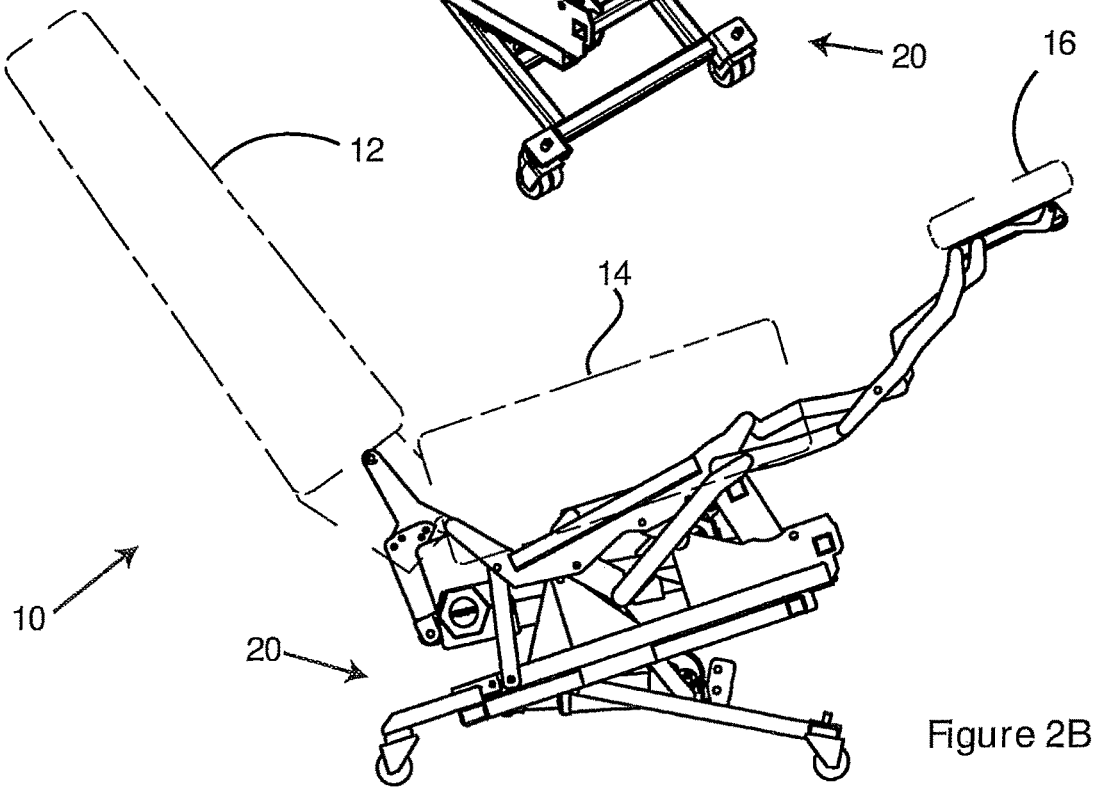
Figure 3A:
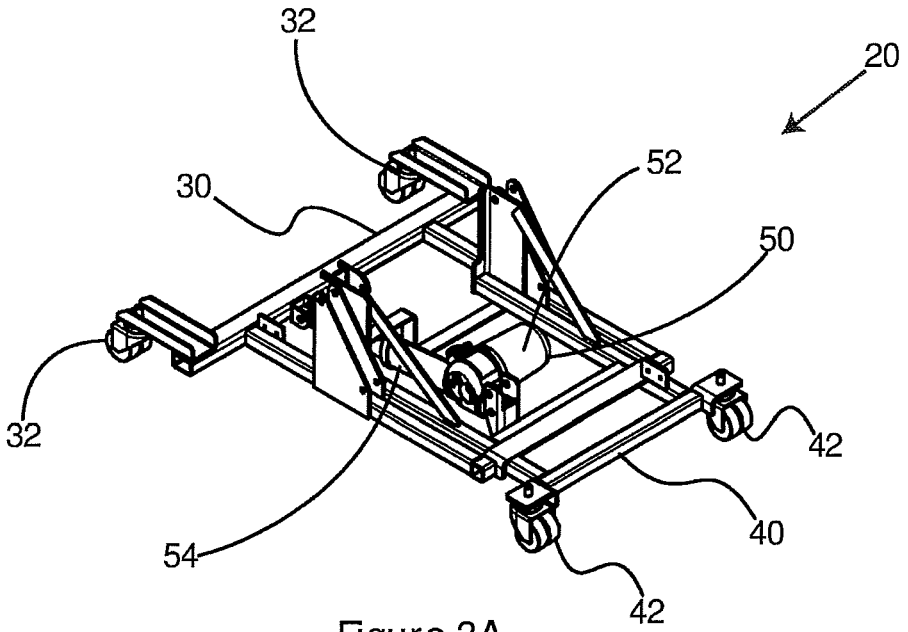
FIGS. 3A and 3B show perspective and side views of the tilting mechanism of the invention in a neutral position.
Figure 3B:
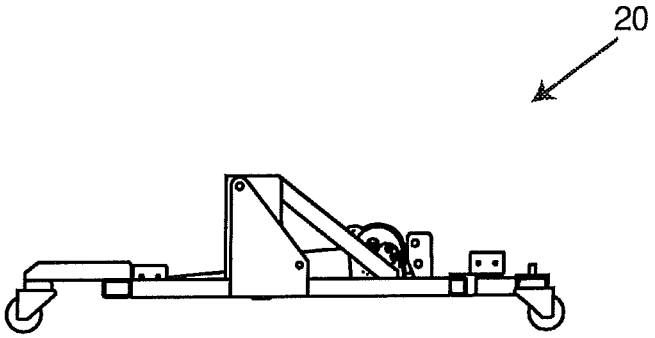

FIGS. 1A and 1B show perspective and side views of a reclining chair 10 incorporating the invention in a neutral position. FIGS. 2A and B the same chair incorporating the invention in a tilted position. The back 12, seat 14 and footrest 16 of the chair are shown in dashed lines to reveal the inner mechanism. The figures are not intended to provide details of the mechanism, but convey how the invention is incorporated into a typical motorized reclining chair mechanism which would be recognized by those skilled in the art. The prior art part of the mechanism shown is typical for a geriatric chair and may have either one or two drive motors and associated linkages to achieve reclining and leg rest extension functions. The invention is aimed equally at bariatric chairs which typically have a further motor to independently recline the back of the chair. The invention comprises a base frame 20 including rear and front sub-frames and a drive mechanism to pivot the sub-frames with respect to each other and thus achieve a tilting function. From the neutral position in FIG. 1A, the footrest 16 is first extended before the back 12, seat 14 and footrest 16 are tilted in unison to achieve a zero gravity position The mechanism of the invention is shown in a neutral position in isolation in the perspective and side views of FIGS. 3A and 3B. The mechanism is a frame 20 comprising a rear sub-frame 30 pivotally connected to a front sub-frame 40, and a drive mechanism 50 to pivot the sub-frames with respect to each other. Various geometries could be used for the frames. Preferably the sub-frames are simple rectangles made from tubular or flat steel, with one sub-frame narrower than the other so that they can nest together. In the preferred embodiment the front sub-frame 40 is narrower than the rear sub-frame 30 and the side rails of the two frames are pivotally joined part way along their sides. Rear wheels 32 are attached to the rear sub-frame and front wheels 42 attached to the front sub-frame. In the neutral position shown in FIGS. 3A and 3B the two sub-frames lie in the same plane to provide a horizontal base to which the remaining chair components can be mounted. The majority of the chair components, i.e. the back, seat and footrest and associated hardware and drive mechanisms, are mounted directly or indirectly by various brackets to the rear sub-frame 30 with the seat of the chair essentially in parallel with the rear sub-frame so that they move in unison with it to achieve a tilting position as the rear sub-frame rotates with respect to the front sub-frame. The arrangement of having the bulk of the chair components effectively connected to the rear sub-frame and rotating the front sub-frame is equally applicable to geriatric or bariatric chair internals.

Figure 4A:
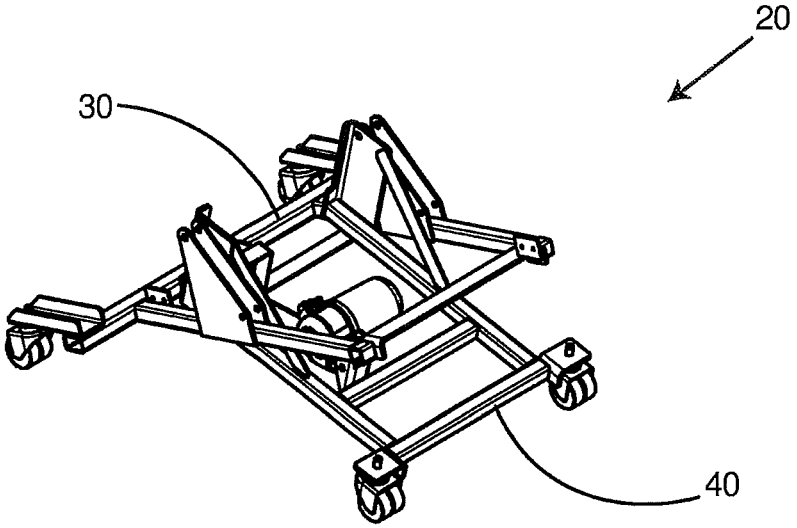
FIGS. 4A and 4B show perspective and side views of the tilting mechanism of the invention in a tilted position.
Figure 4B:
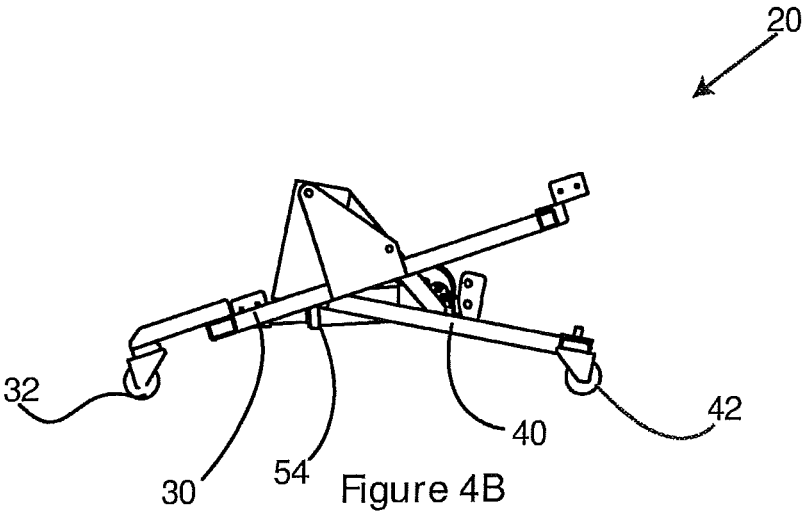

FIGS. 4A and 4B show perspective and side views of the mechanism of the invention in isolation in a tilted position. Tilting is achieved by rotating the front sub-frame 40 and rear sub-frame 30 about their mutual pivot points. Motive force for tilting is provided by drive mechanism 50 which comprises an electric motor 52 and a linear actuator 54. The drive mechanism acts between a cross member of the rear sub-frame and a cross member of the front sub-frame, either drawing them together or pushing them apart to effect the rotation of the sub-frames and hence tilting of the seat. The tilting relies on the sub-frames both contacting the ground and as the sub-frames pivot, the points of contact moving with respect to each other. This movement is best facilitated by the wheels 32 and 42. The wheels may be conventional wheel, castors or rollers; even low friction ends of the sub-frames could be used instead at either or both ends. Wheels are preferred as they also allow for easy movement of the chair.

The reader will now appreciate the present invention which provides a simple mechanism to tilt a reclining chair to achieve a zero gravity position.

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A tilting mechanism for a chair, comprising:

a first sub-frame rigidly connected to a seat of the chair and in contact with the ground at a rear of the chair, and also connected to a back and a footrest of the chair;

a second sub-frame in contact with the ground at a front of the chair and pivotally connected to the first sub-frame;

a motor to pivotally rotate the first sub-frame and the second sub-frame with respect to each other, wherein pivotal rotation of the first sub-frame and the second sub-frame with respect to each other effects a tilting of the back, seat and footrest of the chair and puts the chair in a zero gravity position;

wherein the back, seat, and footrest are mounted to the first sub-frame with the seat essentially in parallel with the first sub-frame and so that the seat and the first sub-frame move in unison to achieve a tilting position.

2. The tilting mechanism as in claim 1, wherein the first sub-frame is in contact with the ground via wheels.

3. The tilting mechanism as in claim 1, wherein the second sub-frame is in contact with the ground via wheels.

4. The tilting mechanism as in claim 1, wherein the chair is a geriatric chair.

5. The tilting mechanism as in claim 1, wherein the chair is a bariatric chair.

* * * * *